US011326830B2

(12) United States Patent
Jacobi

(10) Patent No.: US 11,326,830 B2
(45) Date of Patent: May 10, 2022

(54) MULTIPLE MODULE MODULAR SYSTEMS FOR REFRIGERATION

(71) Applicant: Robert W. Jacobi, Indianapolis, IN (US)

(72) Inventor: Robert W. Jacobi, Indianapolis, IN (US)

( * ) Notice: Subject to any disclaimer, the term of this patent is extended or adjusted under 35 U.S.C. 154(b) by 0 days.

(21) Appl. No.: 16/831,923

(22) Filed: Mar. 27, 2020

(65) Prior Publication Data

US 2020/0300525 A1 Sep. 24, 2020

Related U.S. Application Data

(63) Continuation of application No. PCT/US2020/024072, filed on Mar. 21, 2020.

(60) Provisional application No. 62/822,175, filed on Mar. 22, 2019.

(51) Int. Cl.
*F25D 19/00* (2006.01)
*F25D 23/06* (2006.01)

(52) U.S. Cl.
CPC ..... *F25D 23/062* (2013.01); *F25B 2339/047* (2013.01); *F25B 2400/21* (2013.01)

(58) Field of Classification Search
CPC ..... F25B 2400/21; F25D 19/00; F25D 23/006
See application file for complete search history.

(56) References Cited

U.S. PATENT DOCUMENTS 1,825,694 A 10/1931 Hobart
2,445,988 A 7/1948 Ayers
3,590,594 A * 7/1971 Arend ..... F25D 17/065 62/117
3,760,868 A 9/1973 Cywin
4,375,831 A 3/1983 Downing, Jr.
4,466,256 A 8/1984 MacCracken
(Continued)

FOREIGN PATENT DOCUMENTS

CN 101915487 A 12/2010
EP 0 936 421 A2 8/1999
(Continued)

OTHER PUBLICATIONS

English Translation of CN 101915487.
(Continued)

*Primary Examiner* — Jonathan Bradford
(74) *Attorney, Agent, or Firm* — Woodard, Emhardt, Henry, Reeves & Wagner, LLP

(57) ABSTRACT

A modular refrigeration system includes refrigeration modules that contain a high side cassette including a compressor and a condenser that is slidable into and out of a framework. A low side cassette including an evaporator is positioned in an area to be refrigerated in proximity to the framework and the high side cassette. A suction refrigerant pipe extends between the high side and low side cassettes and supplies refrigerant to the condenser from the evaporator. A liquid refrigerant pipe returns refrigerant from the condenser to the evaporator. The suction refrigerant pipe and/or liquid refrigerant pipes may include threaded connections and/or quick connects/disconnects to be easily disconnected and allow removal of the high side cassette from the framework. Heat is transferred from the refrigerant to the coolant in the condenser in the high side cassette.

21 Claims, 12 Drawing Sheets

(56) References Cited

U.S. PATENT DOCUMENTS

| | | | | |
|---|---|---|---|---|
| 4,776,182 | A | 10/1988 | Gidseg | |
| 4,852,362 | A | 8/1989 | Conry | |
| 5,335,508 | A | 8/1994 | Tippmann | |
| 5,440,894 | A | 8/1995 | Schaffer et al. | |
| 5,448,896 | A * | 9/1995 | Rushing | A47F 3/0408 62/255 |
| 5,485,878 | A | 1/1996 | Derks | |
| 5,715,703 | A * | 2/1998 | Kopf | F25D 17/065 62/186 |
| 5,816,510 | A | 10/1998 | Earle, III et al. | |
| 5,999,403 | A | 12/1999 | Neustadt | |
| 6,094,934 | A | 8/2000 | Rand et al. | |
| 6,412,550 | B1 | 7/2002 | McLaughlin | |
| 6,651,454 | B1 | 11/2003 | Spiegel | |
| 6,688,129 | B2 | 2/2004 | Ace | |
| 6,749,070 | B2 | 6/2004 | Corbett, Jr. et al. | |
| 6,819,563 | B1 | 11/2004 | Chu et al. | |
| 7,254,952 | B2 | 8/2007 | Lilke | |
| 7,365,973 | B2 | 4/2008 | Rasmussen et al. | |
| 7,484,552 | B2 | 2/2009 | Pfahnl | |
| 7,810,341 | B2 | 10/2010 | Belady | |
| 8,113,010 | B2 | 2/2012 | Carlson | |
| 8,522,565 | B1 | 9/2013 | Hauck et al. | |
| 8,815,093 | B2 | 8/2014 | Mahony | |
| 8,857,202 | B1 | 10/2014 | Meissner | |
| 8,910,491 | B2 | 12/2014 | Iovanel | |
| 9,038,408 | B2 | 5/2015 | Sabo | |
| 9,091,451 | B2 | 7/2015 | Hansen et al. | |
| 9,101,080 | B2 | 8/2015 | Czamara et al. | |
| 9,114,881 | B2 | 8/2015 | Mar | |
| 9,173,307 | B2 | 10/2015 | Lee et al. | |
| 9,352,836 | B2 | 5/2016 | Lamey | |
| 9,839,163 | B2 | 12/2017 | Keisling et al. | |
| 9,901,190 | B2 | 2/2018 | Resch | |
| 9,930,974 | B2 | 4/2018 | Resch | |
| 10,443,909 | B2 | 10/2019 | Wiggs | |
| 2004/0072534 | A1 | 4/2004 | Wiley | |
| 2006/0242983 | A1 | 11/2006 | Spadafora et al. | |
| 2007/0002536 | A1 | 1/2007 | Hall et al. | |
| 2007/0130976 | A1 | 6/2007 | Akehurst et al. | |
| 2007/0167125 | A1 | 7/2007 | Rasmussen et al. | |
| 2007/0209380 | A1 | 9/2007 | Mueller et al. | |
| 2008/0018212 | A1 | 1/2008 | Spearing et al. | |
| 2008/0041077 | A1 | 2/2008 | Tutunoglu | |
| 2008/0116289 | A1 | 5/2008 | Lochtefeld | |
| 2008/0163632 | A1 | 7/2008 | Kaga et al. | |
| 2008/0164006 | A1 | 7/2008 | Karamanos | |
| 2008/0198549 | A1 | 8/2008 | Rasmussen et al. | |
| 2008/0202154 | A1 * | 8/2008 | Salt | F25D 19/02 62/498 |
| 2009/0019874 | A1 | 1/2009 | Park | |
| 2009/0107163 | A1 | 4/2009 | Lu et al. | |
| 2009/0112368 | A1 | 4/2009 | Mann, III et al. | |
| 2009/0120108 | A1 * | 5/2009 | Heinbokel | F25B 9/008 62/78 |
| 2009/0151388 | A1 | 6/2009 | Platt et al. | |
| 2010/0132390 | A1 | 6/2010 | Platt et al. | |
| 2010/0139886 | A1 | 6/2010 | Desmeules | |
| 2010/0188816 | A1 | 7/2010 | Bean, Jr. et al. | |
| 2010/0236750 | A1 | 9/2010 | Naneff et al. | |
| 2010/0288772 | A1 | 9/2010 | Novotny et al. | |
| 2010/0300129 | A1 | 12/2010 | Bean, Jr. et al. | |
| 2010/0307178 | A1 | 12/2010 | Hansen et al. | |
| 2010/0315775 | A1 | 12/2010 | Grantham et al. | |
| 2011/0063778 | A1 | 3/2011 | Brouiliard | |
| 2011/0168379 | A1 | 7/2011 | Morgan et al. | |
| 2011/0252821 | A1 | 10/2011 | Miglio | |
| 2011/0299242 | A1 | 12/2011 | Grantham et al. | |
| 2012/0012283 | A1 | 1/2012 | Bean, Jr. et al. | |
| 2012/0113592 | A1 | 5/2012 | Chen | |
| 2012/0125028 | A1 | 5/2012 | Keisling et al. | |
| 2012/0134108 | A1 | 5/2012 | Brouillard | |
| 2012/0255706 | A1 | 10/2012 | Tadayon et al. | |
| 2012/0261091 | A1 | 10/2012 | Krecke | |
| 2012/0273185 | A1 | 11/2012 | Arimilli et al. | |
| 2012/0297811 | A1 | 11/2012 | Miglio | |
| 2013/0032310 | A1 | 2/2013 | Jaena et al. | |
| 2013/0037236 | A1 | 2/2013 | Saunier | |
| 2013/0077238 | A1 | 3/2013 | Babish et al. | |
| 2013/0105139 | A1 | 5/2013 | Campbell et al. | |
| 2013/0107447 | A1 | 5/2013 | Campbell et al. | |
| 2013/0228309 | A1 | 9/2013 | Wood | |
| 2014/0048244 | A1 | 2/2014 | Wallace | |
| 2014/0060107 | A1 | 3/2014 | Chen et al. | |
| 2014/0206271 | A1 | 7/2014 | Ignacio | |
| 2014/0230472 | A1 | 8/2014 | Coradetti et al. | |
| 2014/0284275 | A1 | 9/2014 | Boccato et al. | |
| 2015/0013370 | A1 | 1/2015 | Wiggs | |
| 2015/0040607 | A1 | 2/2015 | Miglio | |
| 2015/0193320 | A1 | 7/2015 | Yu et al. | |
| 2015/0198353 | A1 | 7/2015 | Platt | |
| 2015/0272345 | A1 | 10/2015 | Bhatia et al. | |
| 2015/0351290 | A1 | 12/2015 | Shedd | |
| 2016/0021793 | A1 | 1/2016 | Chen | |
| 2016/0107561 | A1 | 4/2016 | Senaydin | |
| 2016/0305702 | A1 | 10/2016 | Nikaido et al. | |
| 2016/0334170 | A1 * | 11/2016 | Grenz | F02G 5/00 |
| 2017/0074560 | A1 | 3/2017 | Ring | |
| 2017/0086333 | A1 | 3/2017 | Roy | |
| 2017/0105313 | A1 | 4/2017 | Shedd et al. | |
| 2017/0215620 | A1 | 8/2017 | Dade et al. | |
| 2017/0268792 | A1 | 9/2017 | Costakis et al. | |
| 2018/0027698 | A1 | 1/2018 | Cader et al. | |
| 2018/0120017 | A1 * | 5/2018 | Wilson | F25D 17/06 |
| 2018/0231295 | A1 | 8/2018 | Akiyama et al. | |
| 2018/0306492 | A1 | 10/2018 | Nanos et al. | |
| 2018/0363969 | A1 | 12/2018 | Jacobi | |
| 2018/0372369 | A1 | 12/2018 | DeMonte et al. | |
| 2019/0032987 | A1 | 1/2019 | Tippmann et al. | |
| 2019/0195514 | A1 | 6/2019 | White | |
| 2019/0226749 | A1 | 7/2019 | Lee | |

FOREIGN PATENT DOCUMENTS

| | | | | |
|---|---|---|---|---|
| EP | 2 594 485 | A1 | 5/2013 | |
| FR | 3034849 | | 10/2016 | |
| JP | 2002-310524 | A | 10/2002 | |
| JP | 2012-117778 | A | 6/2012 | |
| WO | WO 1986/00977 | A1 | 2/1986 | |
| WO | WO 1991/005977 | | 5/1991 | |
| WO | WO 199105977 | | 5/1991 | |
| WO | WO 2013/189013 | A1 | 12/2013 | |
| WO | WO 2014/130545 | A1 | 8/2014 | |
| WO | WO 2015/066764 | | 5/2015 | |
| WO | WO 2015/136156 | A1 | 9/2015 | |
| WO | WO-2018022503 | A1 * | 2/2018 | F25D 13/02 |

OTHER PUBLICATIONS

English Translation of JP 2012-117778.
PCT Search Report dated Jul. 10, 2020 for PCT/US/2020/024072.
PCT Written Opinion dated Jul. 10, 2020 for PCT/US2020/024072.
English Abstract of FR 3034849 A1 obtained from Lexis-Nexis Total Patent on Nov. 29, 2019.
English Machine Translation of JP 2002-310524 A obtained from WIPO Feb. 7, 2019.

* cited by examiner

MULTIPLE MODULE MODULAR SYSTEMS FOR REFRIGERATION

CROSS-REFERENCE TO RELATED APPLICATIONS

This application is a continuation of PCT/US2020/24072, filed on Mar. 21, 2020, and which claims the benefit of U.S. Provisional Application No. 62/822,175 filed on Mar. 22, 2019, both of which are hereby incorporated by reference.

BACKGROUND

Modular designs and modular construction are currently employed in a variety of settings and for a variety of applications. When one thinks of a "modular design", one description which is applicable to the present invention is a design approach which divides a larger system or network into smaller parts, i.e. modules, which can be independently created, typically or often standardized in construction and function, and used in combination for the larger system or network. A modular design is also described as functional partitioning into discrete scalable, reusable modules with the use of well-defined modular interfaces. Industry standards are often used for the interfaces or at least considered as a part of the interface design.

Modular designs and modular design concepts are found in the electronics industry, home construction, military systems, and the like. However, these "modules" are not usually of the same construction as multiples of a particular equipment or functional design in order to multiply capacity. Instead, many of these other applications involve a "modular" concept which is limited to independent packaging of a particular function which is to be networked with other modules of a different construction for the completion of a larger system or network. For example, a computer may have as its typical "modules" power supply units, processors, main boards, graphics cards, hard drives, optical drives, etc.

Modular design is an attempt to combine the advantages of standardization with those of customization. While some form or variation of modular design has found its way into a number of industries and applications, the concept has had limited success for HVAC, industrial process cooling, low-temperature heating and in refrigeration systems. The present invention is directed to enhanced modular design utilization in these areas and in related areas and applications.

SUMMARY

The present disclosure provides modular refrigeration systems that include at least one insulated cabinet (e.g., cooler cabinet), such as a cabinet for a refrigerator or freezer. In instances having multiple insulated cabinets, spacer panels may be included between adjacent cabinets.

The modular refrigeration systems can include a first (e.g., "high side") portion of a refrigeration module positioned above the insulated cabinets and a second (e.g, "low side") in communication with an interior of the insulated cabinet. Each refrigeration module can include a first (e.g., "high side") cassette having a housing. Each refrigeration module may also include a second (e.g., "low side") cassette having a housing.

The first and/or second cassette may be positioned within a framework of the refrigeration module. The first and/or second cassette may include a sliding base arranged to slide the cassette into and out of the framework.

A structural support beam may support the refrigeration module in and/or near the cooler cabinet. At least one vibration isolation pad may be positioned between the structural support beam and the insulated cabinet and/or refrigeration module.

The refrigeration module may include an insulated enclosure (e.g., configured for sound insulation) and/or a sliding base arranged for slidable insertion and/or removable of the first and/or second cassette. Module spacers may separate adjacent refrigeration modules.

The refrigeration module may define a rear chase positioned between the cassette and framework of the refrigeration module. The rear chase preferably provides space for mechanical (e.g., pipes) and electrical (e.g., power and/or communication wiring) refrigeration componentry utilized by the refrigeration system. For example, the rear chase may include infrastructure, piping, and/or wiring that can connect to at least one cassette of the refrigeration modules in series and/or parallel.

The first cassette may include a compressor and a heat exchanger (e.g., a brazed plate heat exchanger), that operates as a condenser, connected by a refrigerant pipe (e.g., a hot gas refrigerant pipe). The heat exchanger may be connected to a pair of cassette hydronic isolation valves. The cassette hydronic isolation valves may be operable manually and/or automatically. Each of the cassette hydronic isolation valves may be connected to a corresponding chase hydronic isolation valve located in the rear chase. The hydronic isolation valve(s) may be connected to the chase hydronic isolation valve(s) by at least one removable flex pipe. Preferably, the removable flex pipe allows the cassette 31 to be slid at least partially out of the refrigeration module and away from the rear chase without disconnecting the heat exchanger from coolant flow.

The chase hydronic isolation valve is fluidly connected to a condenser coolant supply manifold to connect the heat exchanger within the refrigeration module to a main system heat exchanger that is arranged to provide coolant to at least one refrigeration module within the refrigeration system. The chase hydronic isolation valve is fluidly connected to a condenser coolant return manifold which returns coolant from the heat exchanger to the main system heat exchanger of the entire refrigeration system.

Refrigerant isolation valves may be located within the first and/or second cassettes. Refrigerant isolation valves may be located in a suction refrigerant pipe extending between an evaporator and the compressor and/or a liquid refrigerant pipe extending between a heat exchanger (e.g., condenser) and evaporator. Flexible refrigerant piping preferably extends at least partially between the first and second cassettes so that at least one cassette may be removed from framework without disconnecting the flexible refrigerant piping.

A cassette (e.g., the second cassette) may include a defroster (e.g., defrost coil) and/or defogger. The defroster may be configured to remove condensation from the evaporator, and the defogger may be configured to remove condensation from a glass door of the insulated cabinet. The defroster and/or defogger may be in fluid communication with the heat exchanger (e.g., condenser). Preferably, the defroster and/or defogger are in fluid communication with coolant of the heat exchanger; however, the defroster and/or defogger may be alternatively or additionally be in fluid communication with refrigerant of the heat exchanger. At least one isolation valve may separate the defroster and/or defogger from the condenser. Preferably at least one isolation valve in each cassette separates the defroster and/or defogger from the condenser. More preferably, a least two isolation valves in each cassette separate the defroster and/or defogger from fluid communication with the condenser.

The refrigeration module may include a media display. Such media display may be positioned on a first side of the first cassette. Preferably, the media display is on the same side of the refrigeration module as a glass door of the insulated cabinet.

There are several benefits to the modular refrigeration system described herein. Advantageously, there is a significant reduction in the length of refrigerant piping, thus decreasing the amount of refrigerant needed to run the system. The decreased amount of refrigerant needed means that less refrigerant is lost when leaks occur, saving cost on replacing lost refrigerant. There is also less piping where a leak may develop, thus reducing the likelihood of a leak in the first place.

The modular arrangement of the modular refrigeration system can also reduce down time when there is a failure of a refrigeration module. The first and/or second cassettes are/is designed to be easily removable in the event of a failure of a component of the refrigeration system.

Refrigeration modules may be arranged side-by-side, one above the other, and/or back-to-back. Preferably, refrigeration modules share a chase. Refrigeration modules may be used to cool a cold storage room. Multiple refrigeration modules may be arranged in series and/or parallel.

Refrigeration modules may be arranged with the first cassette positioned on the exterior and/or on the roof of a cold storage room and/or the second cassette positioned within, or at least in communication with, the interior of the cold storage room. Again, multiple refrigeration modules may be arranged in series and/or parallel. The modular refrigeration system may also be used to provide cooling for a refrigerated trailer or shipping container. Such systems may be combined with an adiabatic cooler to pre-cool air entering a heat exchanger. Preferably air flows from a first long side of the shipping container to a second long-side of the shipping container.

DESCRIPTION OF THE SELECTED EMBODIMENTS

Figure 1:
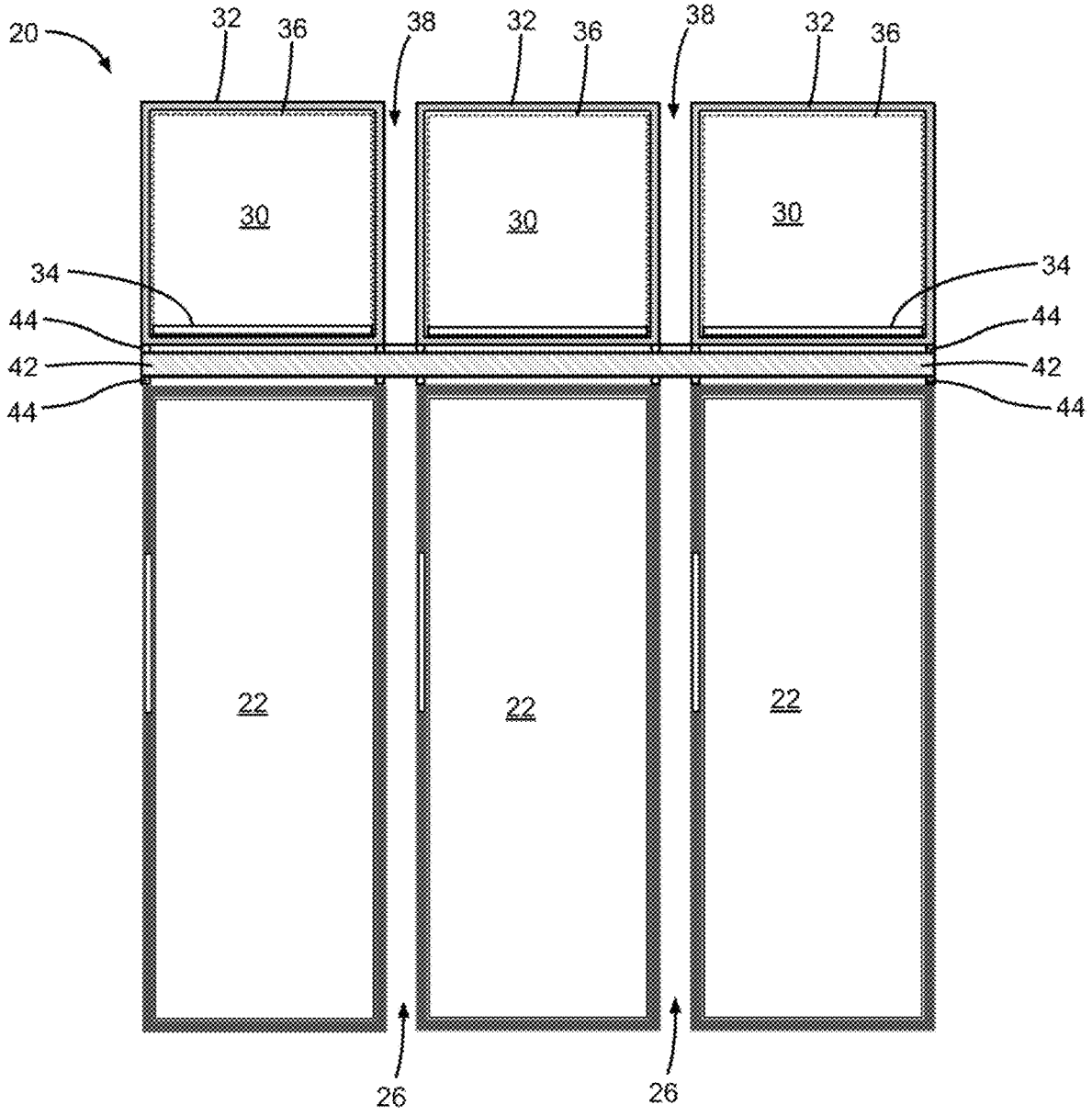
FIG. 1 shows a front elevation view of a modular refrigeration system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates an elevation, front view of a modular refrigeration system 20 that includes a set of three vertical cooler cabinets 22. The cooler cabinets 22 may be refrigerators or freezers, or any other sort of structure that is maintained at a different temperature than the surrounding environment. Cooler spacer panels 26 may be included between the cooler cabinets 22 to separate the adjacent cooler cabinets 22.

A high side portion of a refrigeration module 30 is positioned above each of the vertical cooler cabinets 22. Each refrigeration module 30 includes a high side cassette 31 having a housing (see FIG. 2) that is positioned within a framework 32. The high side cassette 31 may optionally include a sliding base 34 that is capable of sliding the high side cassette 31 into and out of the framework 32. In some embodiments, the refrigeration module 30 also includes an insulated enclosure 36, with the sliding base 34 integrated within the insulated enclosure 36. Module spacers 38 separate the adjacent refrigeration modules 30.

A structural support beam 40 may be provided between the cooler cabinets 22 and the refrigeration modules 30 to support the framework 32 of the refrigeration modules 30. A vibration isolation pad 44 may be positioned on one or more sides of the structural support beam 40. In the illustrated arrangement, a vibration isolation pad 44 is positioned between the vertical cooler cabinets 22 and the structural support beam 40 and another vibration isolation pad 44 is positioned between the refrigeration module 30 and the structural support beam 40.

Figure 2:
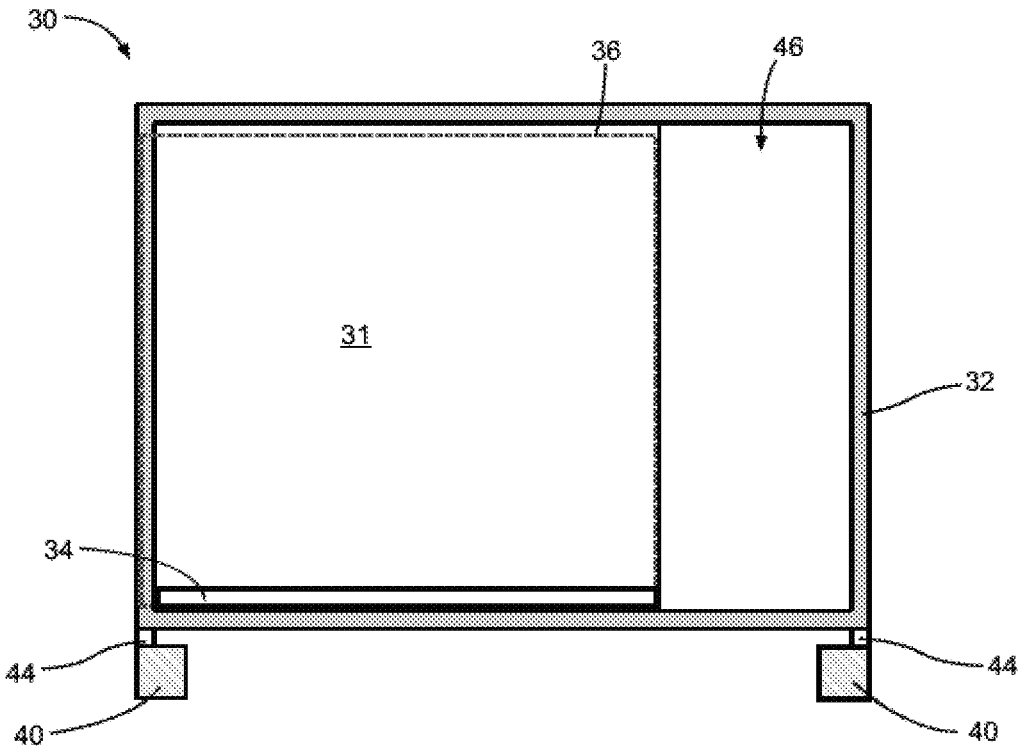
FIG. 2 shows a side elevation view of the high side of a refrigeration module of the modular refrigeration system of FIG. 1.

FIG. 2 shows a side view of the high side portion of the refrigeration module 30. As shown in FIG. 2, the sliding base 34 and the insulated enclosure 36 may extend only part of the way into the frame work 32 so as to define a rear chase 46 positioned between the insulted enclosure 36 and the framework 32. The rear chase 46 provides space for some the mechanical (e.g., pipes) and electrical (e.g., power and/or communication wiring) refrigeration componentry utilized by the refrigeration system 20 to be stored within the framework 32 of the refrigeration module 30.

Figure 3:
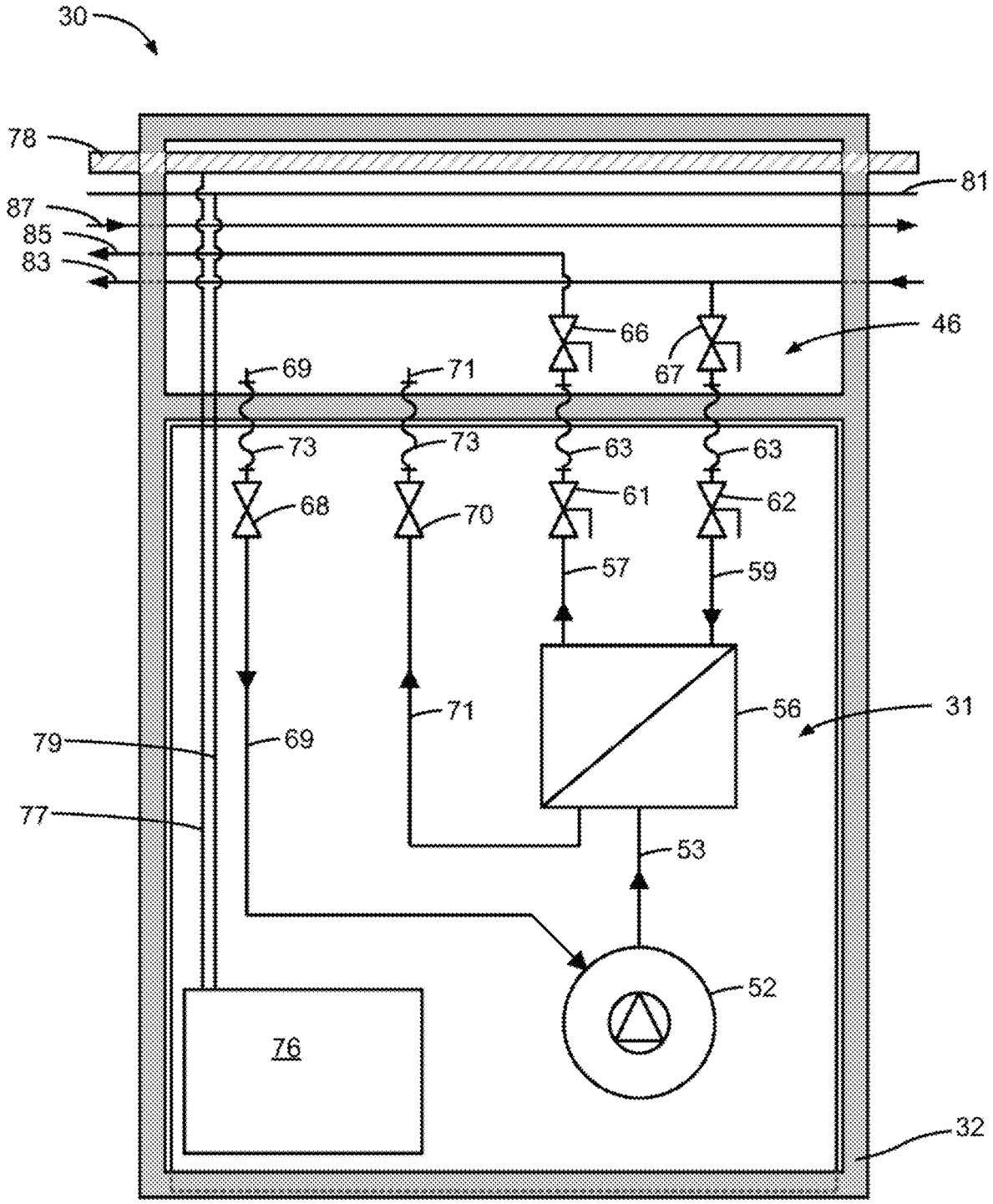
FIG. 3 shows a cutaway top view of the high side of the refrigeration module of FIG. 2.

A top, cutaway view of the high side of refrigeration module 30 is illustrated in FIG. 3. As shown, the framework 32 defines a high side cassette 31 and a rear chase 46. Each of the refrigeration modules 30 includes components within the high side cassette 31 that are designed to work in conjunction with at least a single vertical cooler cabinet 22. In some instances, the components within the rear chase 46 includes infrastructure, piping, and wiring that can connect to each of the refrigeration modules 30 in series and/or parallel.

A compressor 52 and a heat exchanger (e.g., a brazed plate heat exchanger) that operates as a condenser 56 are located within high side cassette 31 and connected by a refrigerant pipe 53 (e.g., a hot gas refrigerant pipe). The condenser 56 may be connected to a pair of cassette hydronic isolation valves 61, 62. The cassette hydronic isolation valves 61, 62 may be either manual or automated. One of the cassette hydronic isolation valves 61 is connected to the condenser 56 by a condenser outlet 57, while the other cassette hydronic isolation valve 62 is connected to the condenser by a condenser inlet 59. Each of the cassette hydronic isolation valves 61, 62 may be connected to a corresponding chase hydronic isolation valve 66, 67 located in the rear chase 46. Each of the cassette hydronic isolation valves 61, 62 may be connected to a corresponding chase hydronic isolation valve 66, 67 by a removable flex pipe 63. The removable flex pipe 63 allows the cassette hydronic isolation valves 61, 62 to be easily separated from the chase hydronic isolation valves 66, 67 when the high side cassette 31 is slid at least partially out of the refrigeration module 30 and away from the rear chase 46. Removing the flex pipe 63 will disconnect the condenser 56 from coolant flow.

The condenser inlet 59 may connect to cassette hydronic isolation valve 62, which is preferably connected to chase hydronic isolation valve 67 by a flex pipe 63. The chase hydronic isolation valve 67 is fluidly connected to a condenser coolant supply manifold 83 to connect the condenser 56 within the refrigeration module 30 to a main system heat exchanger 92 (see FIG. 4) that is capable of providing coolant to multiple refrigeration modules 30 within the refrigeration system. The condenser outlet 57 is fluidly connected to cassette hydronic isolation valve 61, which is preferably connected to chase hydronic isolation valve 66 by a flex pipe 63. The chase hydronic isolation valve 66 is fluidly connected to a condenser coolant return manifold 85 which returns coolant from the condenser 52 to the main system heat exchanger 92 of the entire refrigeration system. The condenser system may also include an optional reverse return coolant supply 87.

Refrigerant isolation valves 68, 70 are also located within the high side cassette 31. Refrigerant isolation valve 68 is connected to compressor 52 by a suction refrigerant pipe 69. Refrigerant isolation valve 70 is connected to condenser 56 by a liquid refrigerant pipe 71. The suction refrigerant pipe 69 and the liquid refrigerant pipe 71 extend through the respective refrigerant isolation valves 68, 70 and extend exterior to the refrigeration module 30 by running through the rear chase 46. The exterior portions of the refrigerant pipe 69 and the refrigerant pipe 71 are connected to exterior refrigerant isolation valves that may be operated to turn on or off. Flexible refrigerant piping 73 preferably extends between the high side cassette 31 and the rear chase 46 to connect the exterior portions of the suction refrigerant pipe 69 and the liquid refrigerant pipe 71 to the respective refrigerant isolation valves 68, 70 and to the portions of the suction refrigerant pipe 69 and the liquid refrigerant pipe 71 positioned inside the high side cassette 31. When the refrigerant isolation valves 68, 70 and the exterior portions of the suction refrigerant pipe and liquid refrigerant pipe are closed (e.g., by closure of king valves), the flexible refrigerant piping 73 may be disconnected so the high side cassette 31 may be removed from the framework 32.

Electrical power is provided to the compressor 52 by a control panel 76. Control panel 76 is connected to a power source by a power supply wire 77 (e.g., a high voltage wire) that is connected to an electrical busbar 78 for distribution of electrical power. The high voltage wire 77 may include a disconnecting device that allows the high voltage wire 77 to be disconnected from the electrical busbar 78. Control panel 76 is also connected to a control conduit by control conduit wiring 81 that is electrically connected to control and data wiring 79 (e.g., low voltage wire). The control data wiring 79 and the control conduit wiring 81 connect the control panel to refrigeration control accessories or ports that are standard in a refrigeration or coolant piping system to control the refrigeration system. When high side cassette 31 is desired to be removed from the refrigeration module, the power supply wire 77 is disconnected from the electrical busbar 78 to cut electrical power to the high side cassette 31, and the control and data wiring 79 is disconnected from the control conduit 81.

Figure 4:
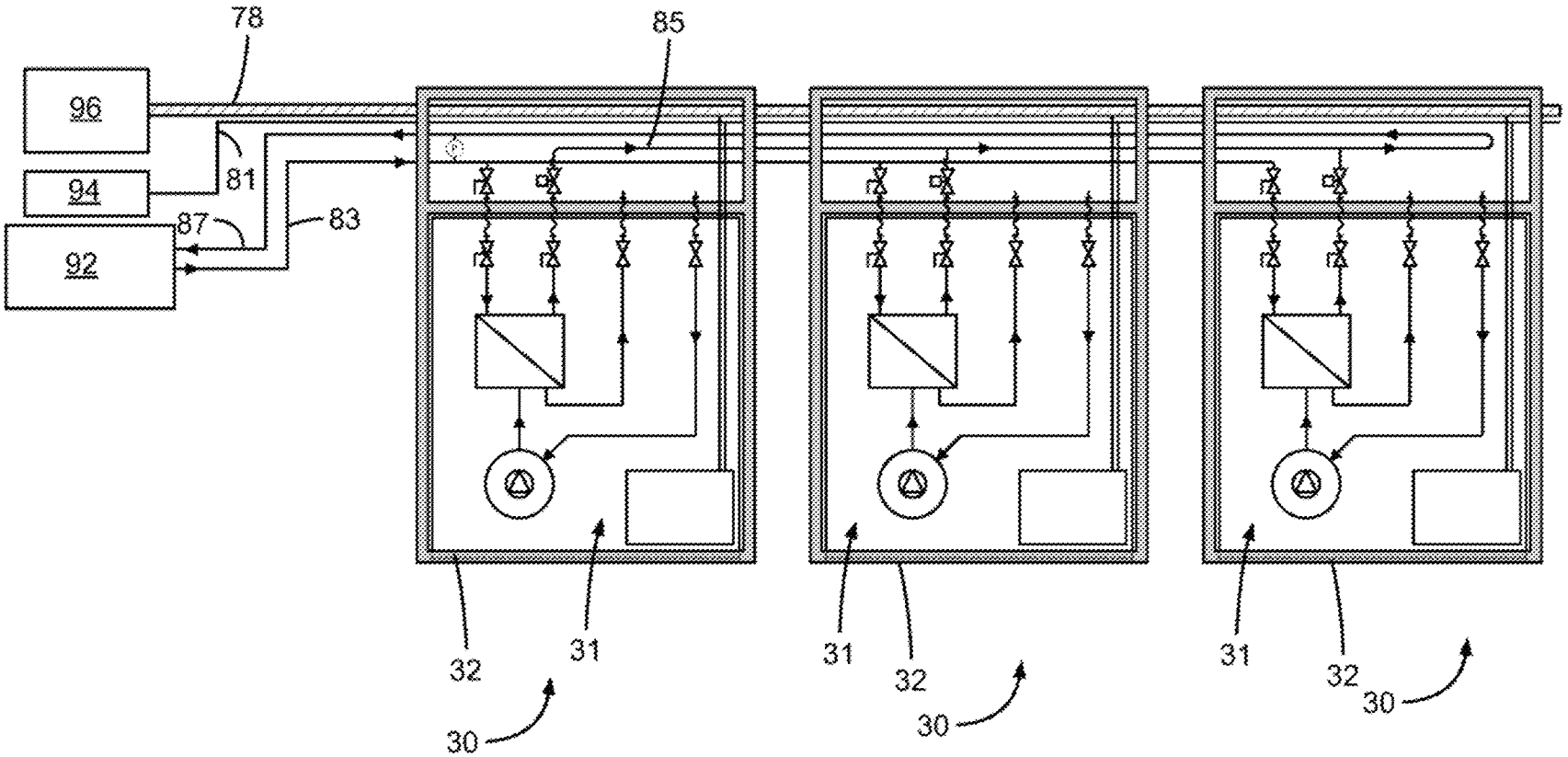
FIG. 4 shows a top view of the refrigeration modules from the modular refrigeration system of FIG. 1.

FIG. 4 illustrates a row of connected refrigeration modules 30. As shown, several of the components from the rear chases 46 extend through framework 32 to connect each refrigeration module 30 to the other refrigeration modules 30 in the row. These components include the electrical busbar 78, the control conduit wiring 81, and the condenser coolant supply manifold 83 which extend through each of the refrigeration modules 30 in the row. Additionally, the condenser coolant return manifold 85 is fluidly connected with the reverse return coolant supply 87 to form a loop for the coolant return to the main system heat exchanger 92. A differential pressure sensor 90 may be connected between the condenser coolant return manifold 85 and the reverse return coolant supply 87 to measure the pressure differential between the two flows to allow for variable speed pump control.

The control conduit wiring 81 is connected to a central control system 94 that operates as a control panel for monitoring and making changes to the operation of the refrigeration modules 30 of the modular refrigeration system 20. The electrical busbar 78 is connected to a central power 96 that provides electrical power for each of the refrigeration modules 30 in the modular refrigeration system 20.

Figure 5:
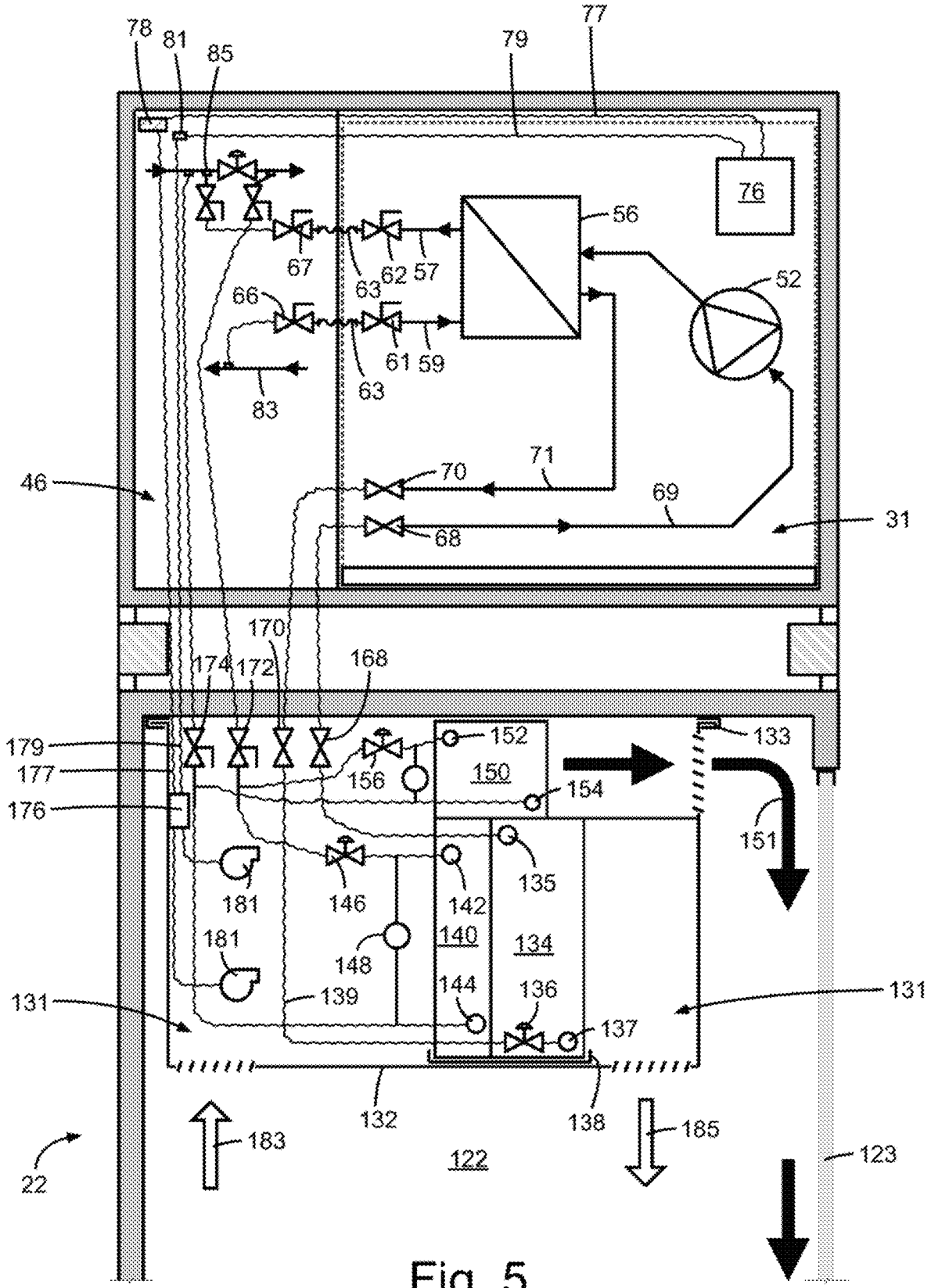
FIG. 5 shows a cutaway side view of a refrigeration module of the modular refrigeration system of FIG. 1.

As shown in FIG. 5, the refrigeration module also includes a low side cassette 131 that resides within the interior 122 of the vertical cooler cabinet 22 and below the high side cassette 31. The low side cassette 131 includes a housing 132 that is attachable to the vertical cooler cabinet 22 at an attachment point 133.

An evaporator coil 134 is positioned within the low side cassette 131. A drain catchment pan 138 is positioned below the evaporator coil 134 to catch any condensate and/or defrost coolant that is produced by the evaporator coil 134. Refrigerant is fed to the evaporator coil 134 by a liquid line 139 that feeds a thermal expansion valve 136 that connects to an evaporator inlet 137 for introducing refrigerant into the evaporator coil 134. The liquid line is in fluid communication with a low side refrigerant isolation valve 170. The low side refrigerant isolation valve 170 is preferably connected to the high side refrigerant isolation valve 70 by a line such as a flex hose. As described above, the high side refrigerant isolation valve 70 is connected to the condenser by the liquid refrigerant pipe 71.

The evaporator coil 134 also includes an evaporator outlet 135 that is in fluid connection with a low side refrigerant isolation valve 168, which in turn, is in fluid connection with the high side refrigerant isolation valve 68. The high side refrigerant isolation valve 68 connects to the compressor 52 by suction refrigerant pipe 69.

A hydronic heating face split or a defrost coil 140 is positioned adjacent to the evaporator coil 134. The defrost coil 140 has a defrost coolant outlet 142 and a defrost coolant inlet 144. The defrost coolant inlet 144 is connected to a low side hydronic isolation valve 174. The low side hydronic isolation valve 174 is connected to the condenser coolant supply manifold 83 by a flex hose. The defrost coolant outlet 142 is connected to a hydronic defrost control valve 146 which leads to a low side hydronic isolation valve 172. The low side hydronic isolation valve 172 is connected to the condenser coolant supply manifold 83 by a flex hose. The hydronic defrost control valve 146 and a differential pressure gauge 148 between the lines connected to the defrost coolant outlet 142 and the defrost coolant inlet 144 control flow into and out of the defrost coil 140 and may help assure that the necessary valves are open when defrost is needed. The defrost coil may alternatively, or additionally, receive hot gas refrigerant exiting the compressor and/or entering the condenser.

In some embodiments, a door defog coil 150 is included to allow a glass door 123 of the cooler cabinet 22 to be defrosted or deiced. The door defog coil includes a door defog outlet 152 and a door defog inlet 154. A door defog control valve 156 is connected to the door defog outlet 152. The door defog control valve 156 feeds into the same low side hydronic isolation valve 172 as the hydronic defrost control valve 146. Similar to the differential pressure gauge 148, a defog differential pressure gauge 158 is positioned between the lines connected to the door defog outlet 152 and the door defog inlet 154. The defrost coil 140 and the door defog coil 150 supply warm coolant and return cooler coolant to the heat rejection main piping in the rear chase 46 using a control valve to regulate the flow of coolant. The door defog coil 150 emits warm air 151 that exits the low side cassette 131 toward the glass door 123 to warm and remove ice and condensation from the glass door 123 so that a customer may see the contents on the interior 122 of the vertical cooler cabinet 22.

Low side cassette 131 includes a control panel 176 which is electrically connected to the electrical busbar 78 and the control conduit wiring 81. The control panel 176 controls blowers 181 that may be used to circulate air within the low side cassette 131. The blowers 181 pull warm air 183 from the top of the interior 122 of cooler cabinet 22 into the low side cassette 131 so that the air can be cooled. The cold air 185 is then discharged from the low side cassette 131 and fed back into the interior 122 of cooler cabinet 22.

Figure 6:
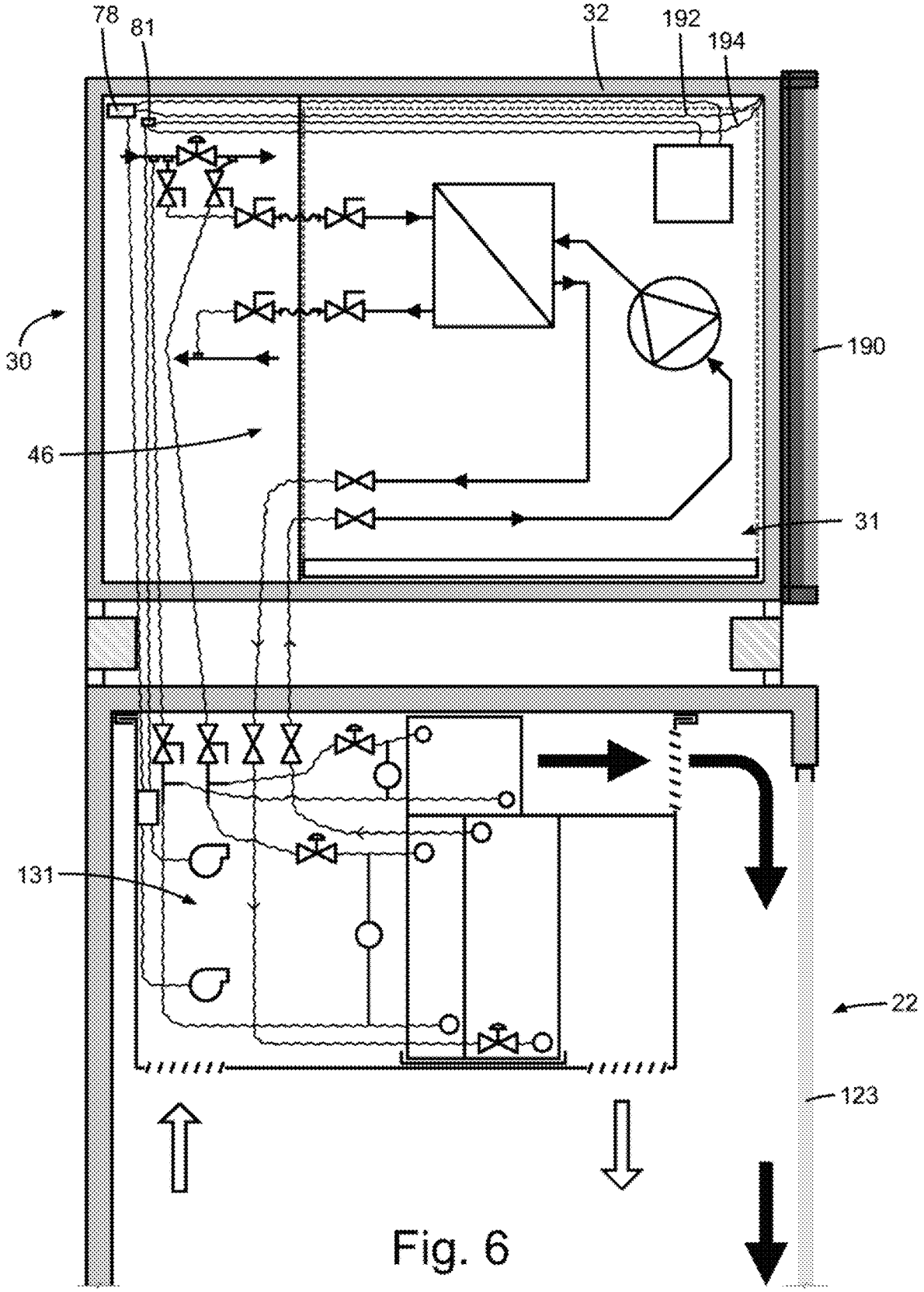
FIG. 6 shows an embodiment of the refrigeration module of FIG. 5 with a fascia mounted media display.

FIG. 6 illustrates a fascia mounted media display 190 that is positioned on the framework 32 of the high side cassette 31. The fascia mounted media display 190 faces the same direction as the glass door 123 of the vertical cooler cabinet 22 and allows for advertisements or information about what is inside the cooler cabinet 22 to be displayed to a customer that walks by the cooler cabinet 22. Electrical wiring 192 connects the fascia mounted media display 190 to the electrical busbar 78 to supply power to power to the fascia mounted media display 190. Additional wiring 194 connects the fascia mounted media display 190 to the control conduit wiring 81 to provide connection to building automation and control units and to media networks.

There are several benefits to the modular refrigeration system that is described above. There is a significant reduction in the length of refrigerant piping, thus decreasing the amount of refrigerant needed to run the system. The decreased amount of refrigerant needed means that less refrigerant is lost when leaks occur, saving cost on replacing lost refrigerant. There is also less piping where a leak may develop, thus reducing the likelihood of a leak in the first place. This is accomplished by having the refrigerant lines only run between high side cassette 31 and the low side cassette 131. Heat that is supplied to the refrigerant from the interior 122 of the cooler cabinet 22 is taken to the high side cassette 31, where the heat is transferred to coolant that is supplied to the condenser 56 from the condenser coolant supply manifold 83. The condenser coolant return manifold 85 takes the heated coolant away from the cooler cabinet 22 to the main system heat exchanger 92 that is located elsewhere in the facility for the heated coolant to be cooled and eventually returned to the condenser coolant supply manifold 83. Since the condenser is exchanging heat with coolant rather than ambient air, a higher efficiency can be achieved. Additionally, there is no need for condenser to be located far away from the evaporator, so as to avoid heating the environment around the coolers/freezers which may be uncomfortable to patrons, thus decreasing the length of piping and the volume of refrigerant needed to operate the system.

The modular arrangement of the modular refrigeration system 20 also reduces down time when there is a failure of a refrigeration module. The high side cassette 31 is designed to be easily removable from the low side cassette 131 in the event of a failure of a component in either portion of the refrigeration system 20. The high side cassette 31 may be removed by disconnecting the refrigerant system, the hydronic system, and the electrical system. The refrigerant system is disconnected by closing the high side refrigerant isolation valves 68, 70 and closing the low side refrigerant isolation valves 168, 170. The hydronic system is disconnected by closing the cassette hydronic isolation valves 61, 62 and the chase hydronic isolation valves 67, 68. The electrical system is disconnected by disconnecting the high voltage wire 77 and the low voltage control and data wiring 79 from the electrical busbar 78 and the control conduit wiring 81.

After disconnecting the refrigerant system, the hydronic system, and the electrical system, the high side cassette 31 may be slid out of framework 32 so that maintenance can be performed on high side cassette 31. While maintenance is performed, a replacement high side cassette 31 may be slid into the framework 32 to resume cooling of the cooler cabinet 22. Additionally, even when a high side cassette 31 is disconnected and removed from the modular refrigeration system 20, the other refrigeration modules 30 may continue to operate because of the arrangement of the refrigeration modules 30 in parallel, as illustrated in FIG. 4, rather than in series. The remaining refrigeration modules maintain their connections with the condenser coolant return manifold 85 and the condenser coolant supply manifold 83, as the refrigerant systems are contained within each refrigeration module 30 and are not connected to other refrigeration modules 30 that may be disconnected from the refrigeration system 20.

Figure 7:
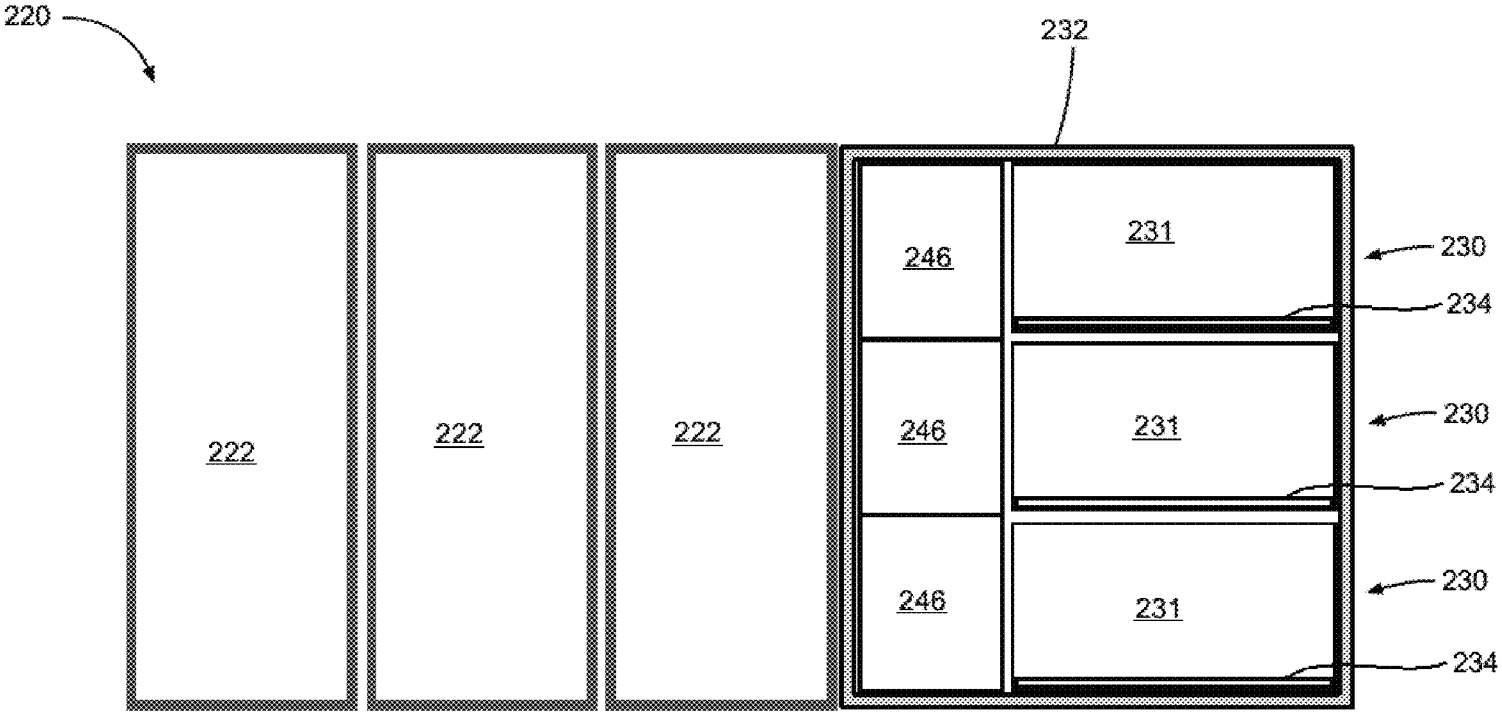
FIG. 7 shows an embodiment of a modular refrigeration system with the refrigeration modules positioned to a side of vertical cooler cabinets.

In other embodiments, the arrangement of the refrigeration modules 30 in the modular refrigeration system 20 may be modified as desired. As an example, in FIG. 7, the modular refrigeration system 220 is arranged so that the refrigeration modules 230 are positioned to the side of the vertical cooler cabinets 222 rather than above the vertical cooler cabinets 222. As shown, there is a single framework 232 that holds the refrigeration modules 230 in the modular refrigeration system 220. The refrigeration modules 230 each include a cassette 231 positioned on a sliding base 234 for removal and insertion into the framework 232 and a chase 246 for holding the piping, electrical wiring, and the control wiring. Each refrigeration module 230 corresponds to a respective vertical cooler cabinet 222 to cool the contents inside the cooler cabinet 222.

Figure 8:
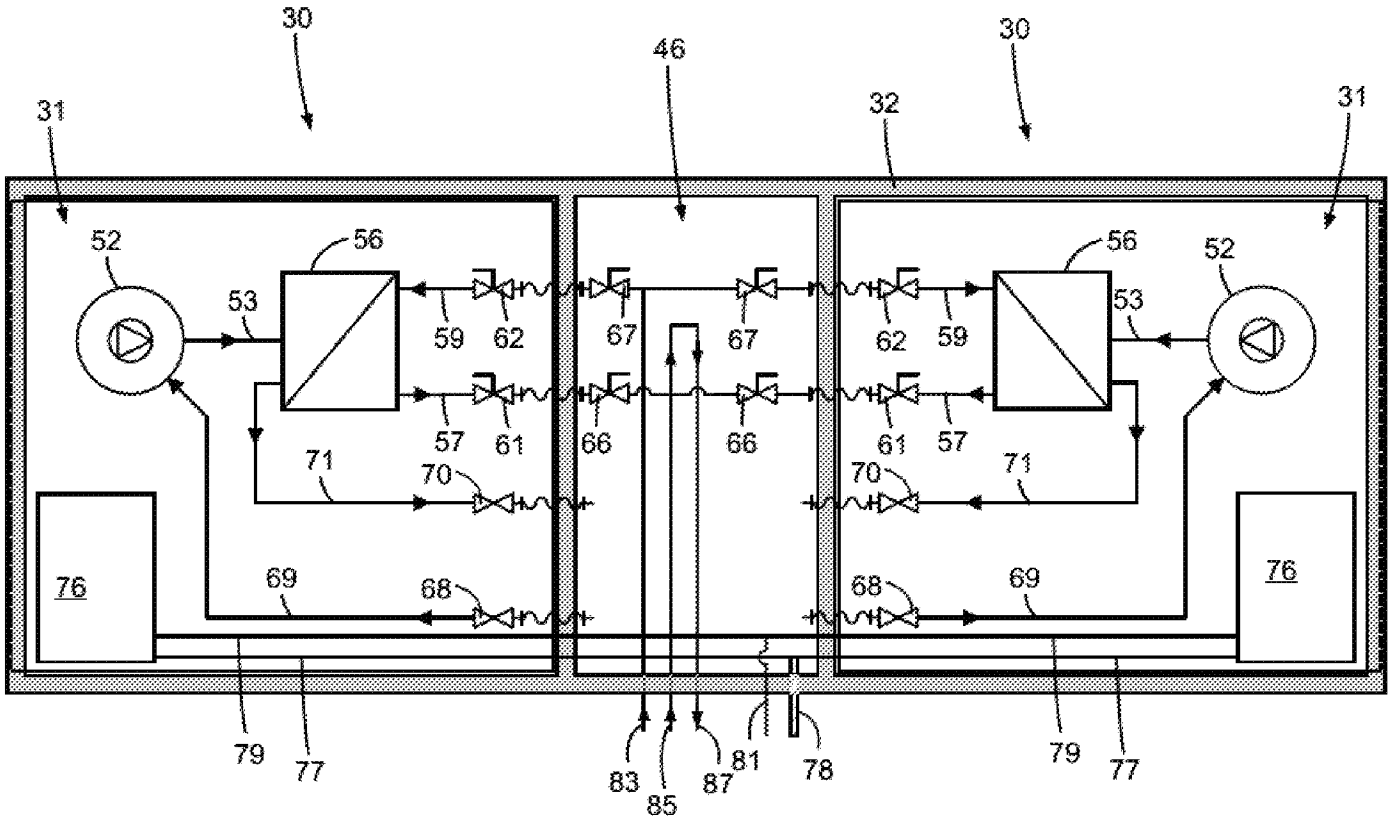
FIG. 8 shows cutaway top or side view of the high side of refrigeration modules in an embodiment of a modular refrigeration system where the refrigeration modules are arranged back-to-back.

As shown in FIG. 8, in some embodiments, refrigeration modules 30 may be arranged back-to-back so that the adjacent refrigeration modules 30 share a rear chase 46. This arrangement may be useful when vertical cooler cabinets 22 are set up back-to-back, for example to create two separate aisles in a grocery store. In this embodiment, the condenser coolant supply manifold 83, the condenser coolant return manifold 85, and the reverse return coolant supply 87 are all positioned within the rear chase 46. The condenser inlet lines 59 and condenser outlet lines 57 from the adjacent refrigeration modules 30 run into the shared rear chase 46 to connect to the condenser coolant supply manifold 83 and to the condenser coolant return manifold 85, respectively. Likewise, the suction refrigerant pipe 69 and the liquid refrigerant pipe 71 from the adjacent refrigeration modules 30 may also run into the shared rear chase 46.

Figure 9:
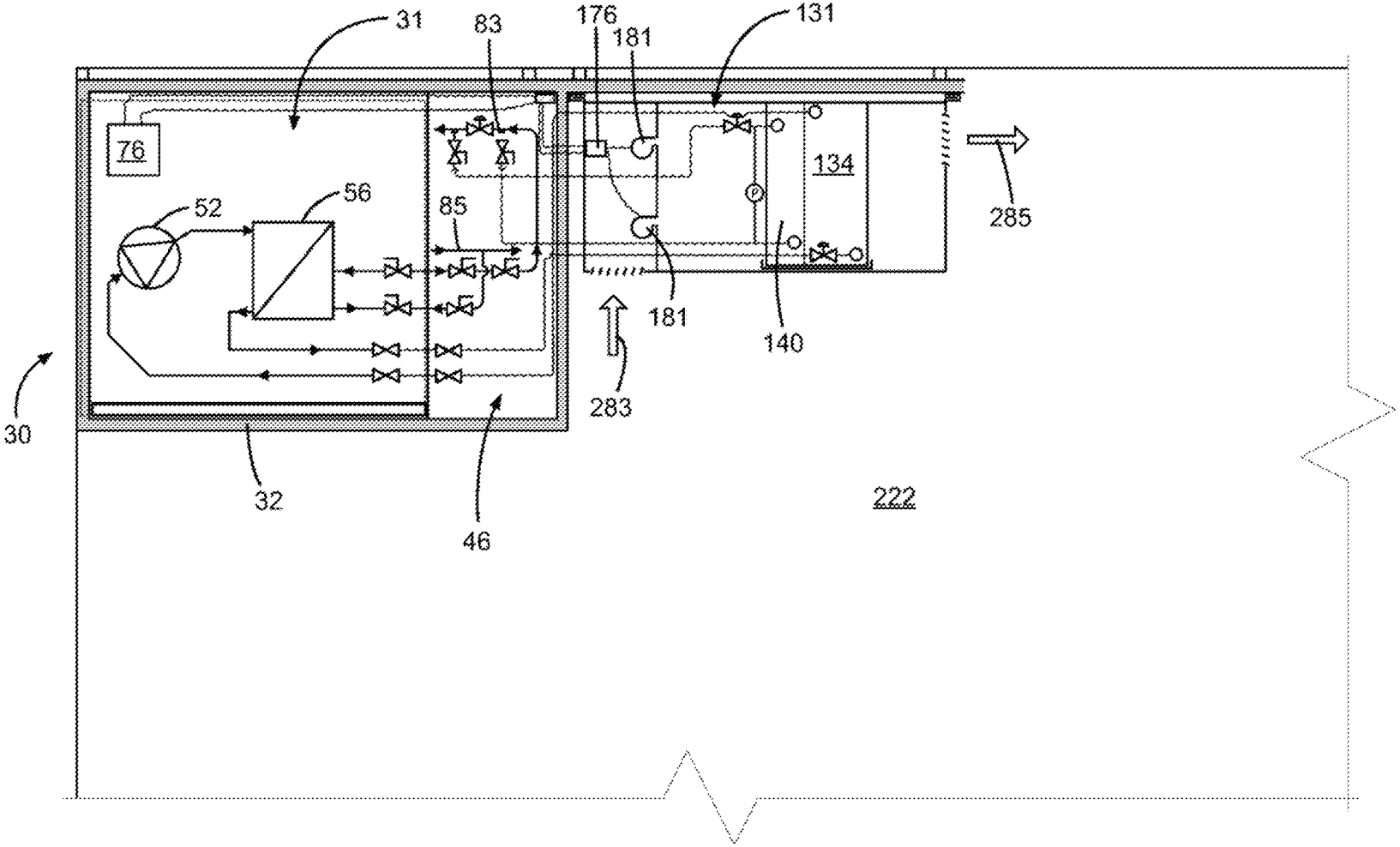
FIG. 9 shows an embodiment of a modular refrigeration system for cooling a cold storage room.

Refrigeration modules 30 are not limited to only being used to cool a cooler cabinet 22. In some embodiments, refrigeration modules 30 may be used to cool a cold storage room. As shown in FIG. 9, a high side cassette 31 and a low side cassette 131 may be arranged in a cold storage room 222, for example, near the ceiling of the cold storage room 222. Warmer air 283 in the cold storage room 222 rises to the top of the room, where it can enter into the low side cassette 131. The warm air is cooled as it passes over the evaporator 134 and the now cold air 285 is then discharged from the low side cassette 131 and fed back into the cold storage room 222. Although only a single refrigeration module 30 is shown in FIG. 9, multiple refrigeration modules 30 may be arranged in series and/or parallel within the cold storage room 222 to provide additional cooling capacity. Additionally, in some embodiments, the refrigeration module or modules 31 contained within cold storage room 222 may be connected in series and/or parallel with refrigeration modules 31 in other cold storage rooms within the same building or complex.

Figure 10:
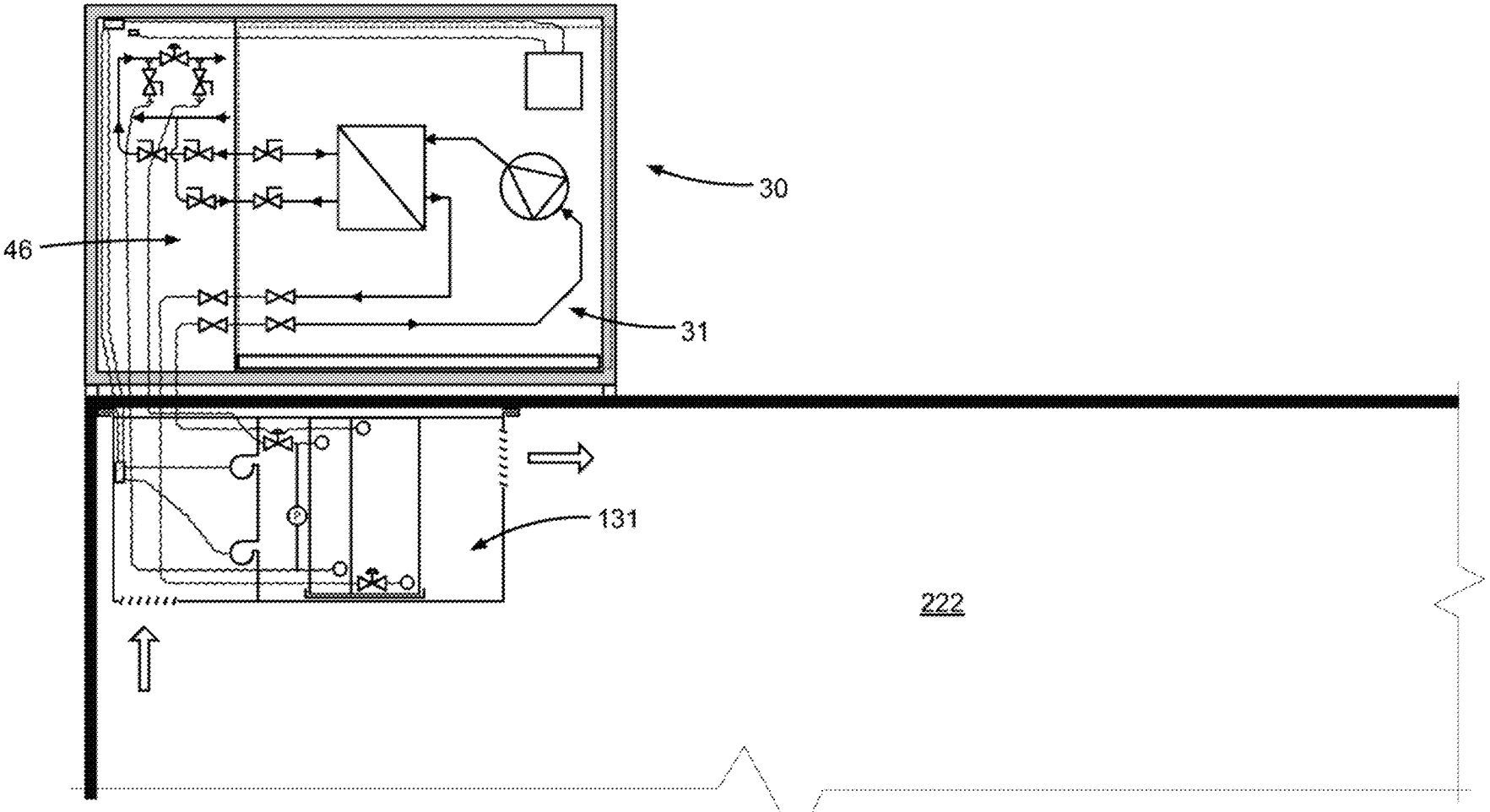
FIG. 10 shows an alternative embodiment of the modular refrigeration system of FIG. 9 where the high side of a refrigeration module is positioned exterior to the cold storage room.

As illustrated in FIG. 10, the refrigeration module may also be arranged with respect to the cold storage room 222 so the high side cassette 31 and rear chase 46 are positioned on the exterior and/or on the roof of the cold storage room 222. The low side cassette 131 is still positioned within, or at least in communication with, the interior of the cold storage room 222. As with the embodiment shown in FIG. 9, multiple refrigeration modules 30 may be arranged in series and/or parallel and may be used to provide additional cooling to accommodate large cold storage rooms 222.

Figure 11:
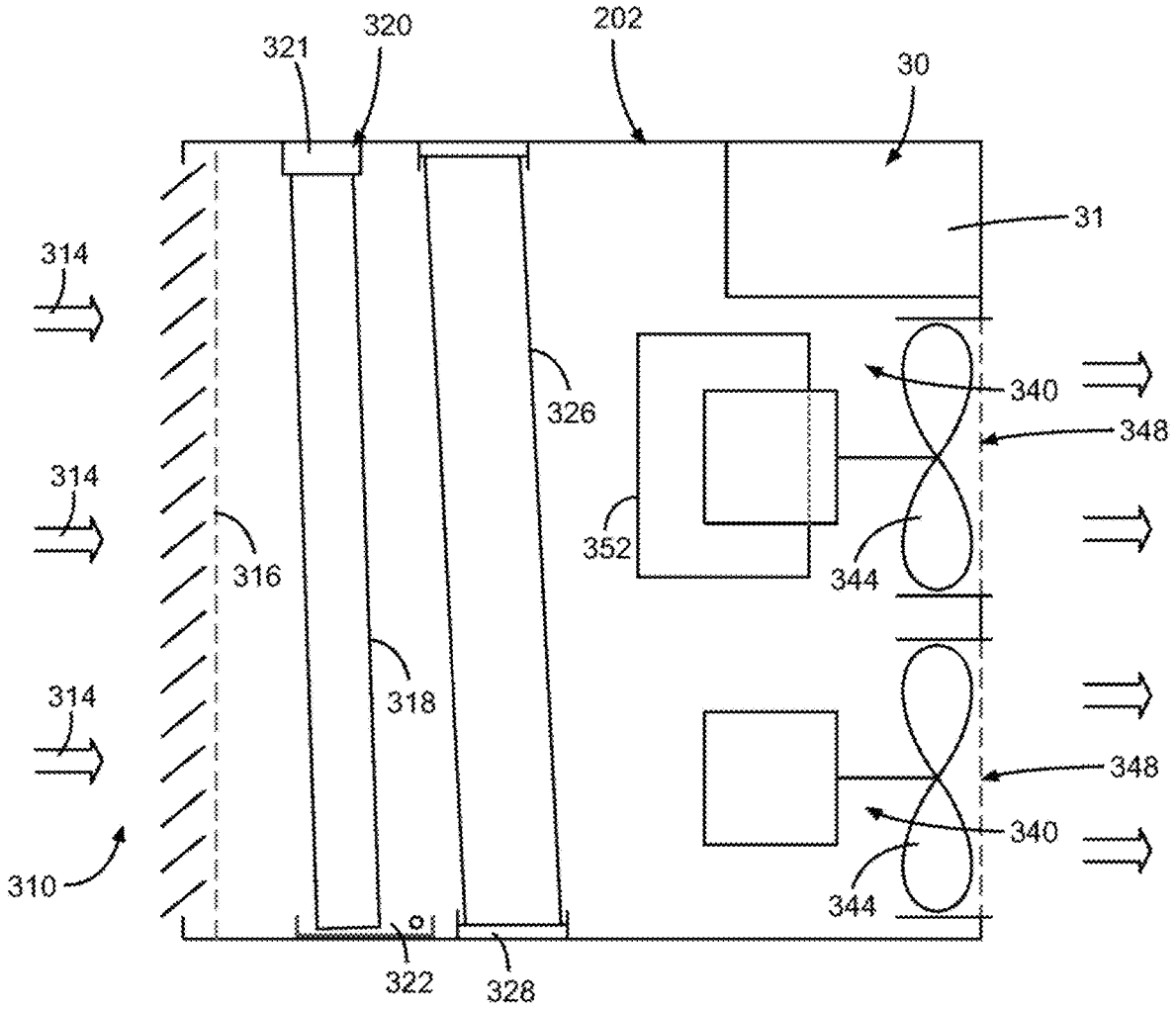
FIG. 11 shows a cross-sectional view of the short side of an embodiment of a refrigeration module for cooling a trailer or shipping container.

The modular refrigeration system 20 may also be used to provide cooling for a refrigerated trailer or shipping container 202, as shown in FIG. 11. A portion of one of the walls of the long side of the shipping container is used as an air inlet 310. The air that enters the shipping container 314 is directed toward an adiabatic cooler 318. The adiabatic cooler includes a spray water system 320 that has a top inlet pan 321 and a catchment basin 322 that is piped to a drain. Condenser coils 326 that act as an air cooler are positioned adjacent to the adiabatic cooler. A condenser catchment tray 328 is positioned beneath the condenser coils 326 and includes an outlet to a drain to remove any excess fluid produced by the condenser coils 326. An air inlet filter may be positioned near the air inlet to prevent debris from collecting in the adiabatic cooler 318 and the condenser coils 326.

The wall of the shipping container 202 opposite of the wall that acts as the air inlet 310 includes condenser fan assemblies 340 that pull or push air through the shipping container. Each condenser fan assembly includes an exhaust fan 344 to discharge condenser air through a fan discharge grille 348. A control panel 352 is mounted on a wall of the shipping container and is attached to the line voltage and control voltage wiring from the motors of the exhaust fans 344 and to the high side cassette 31 of the refrigeration module 30. The low side cassette 131 of the refrigeration module 30 is located on the interior of the refrigerated area of the shipping container 202 (see FIG. 12).

The interior of the high side cassette 31 is open to the ambient air in the shipping container 202 as air is drawn through the condenser fan assemblies 340. In some embodiments, the shipping container may include more than one refrigeration modules 30 that may be used to control the temperature of the refrigerated area of the shipping container 202. The high side cassettes 31 of these additional refrigeration modules 30 may be positioned above the fan assemblies 340 similar to the high side cassette 31 shown in FIG. 11 or may be positioned at the base of the shipping container 202, below the fan assemblies 340.

Figure 12:
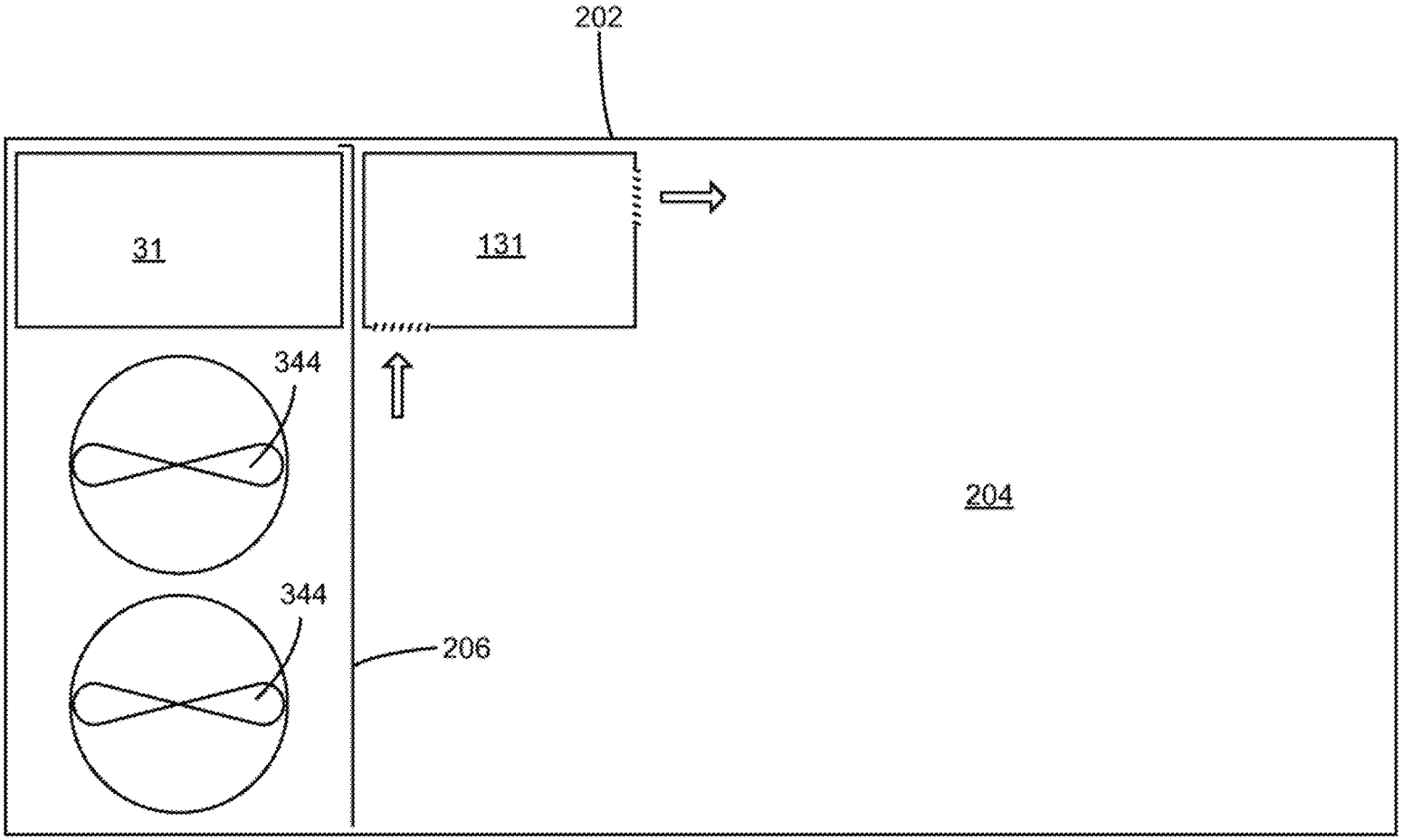
FIG. 12 shows a cross-sectional view of the long side of the refrigeration modules for cooling a trailer or shipping container of FIG. 11.

In some embodiments, the shipping container 202 may contain the high side cassette 31 at one end of the shipping container 202 while the rest of the shipping container 202 is used as a refrigeration space 204 for cold storage, as illustrated in FIG. 12. As shown, the portion of the shipping container 202 that is used to house the high side cassette 31 is separated from the refrigeration space 204 by an insulated dividing wall 206. In other embodiments, the entire shipping container 202 may include multiple high side cassettes 31 with multiple sections of the air cooled or wet/dry condensers or coolers for a large chiller or chiller/heater central plant. In some instances, multiple shipping containers 202 may be joined together for either refrigeration or HVAC duty.

The modular refrigeration system 20 may be used for additional applications other than just those described above. For example, the modular refrigeration system 20 may be used for large area cool, cold or frozen storage or for cold storage trailers and shipping containers. The modular refrigeration system 20 may be used for industrial refrigeration of pharmaceuticals, laboratories, and/or research and development facilities; institutional refrigeration of hospitals, schools, and universities; and, commercial refrigeration of bars and restaurants and/or food service facilities.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The term "cassette" as used herein includes a housing that supports, directly and/or indirectly, the elements disclosed as being included in the cassette. Accordingly, movement of the cassette out of a framework also removes the elements disclosed as being included in the cassette out of the framework. The housing may surround (e.g., partially surround or fully encapsulate) the elements included in the cassette. The housing is preferably arranged to support weight of the elements disclosed as being include in the cassette. The cassette housing may define openings for pipes and/or wiring communicating with one or more elements included in the cassette. The cassette housing may define openings or otherwise provide access to controls of the elements of the cassette (e.g., valves). The cassette may include slides (e.g., low-friction pads and/or linear bearings) to aid in the cassette being slidably receivable into and/or removable from framework, such as the high side of a refrigeration module.

The term "removable" as used herein refers to an ability to be removed without destruction of a cassette housing, framework, and/or cabinet.

The term "coolant" as used herein includes water (e.g., distilled water) as well as water including anti-freeze (e.g., ethylene glycol, propylene glycol, glycerol, etc.) and glycol-based "waterless" coolants.

The terms refrigerator and freezer include commercial and residential units as well as reach-in units.

The term "media display" as used herein includes static displays (e.g., posters) and dynamic displays (e.g., electronic displays). The term includes LCD screens.

The following numbered clauses set out specific embodiments that may be useful in understanding the present invention:

1. A modular refrigerator or freezer comprising:
   an insulated cabinet; and
   a refrigeration module including:
      a compressor, a condenser, and an evaporator;
      a liquid refrigerant pipe extending between the condenser and the evaporator to supply refrigerant from the condenser to the evaporator;
      a suction refrigerant pipe extending between the evaporator and the compressor to supply refrigerant from the evaporator to the compressor;
      wherein the evaporator is in communication with an interior of the insulated cabinet;
      wherein the compressor and condenser are included in a first cassette of the refrigeration module, the first cassette having a first cassette housing;
      wherein the evaporator is included in a second cassette of the refrigeration module, the second cassette having a second cassette housing; and
   wherein the first and/or second cassette are/is removable from the refrigeration module independently of the other cassette.

2. The refrigerator or freezer of clause 1, wherein the first cassette is removable from the refrigeration module independently of the second cassette.

3. The refrigerator or freezer of any preceding clause, wherein the second cassette is removable from the refrigeration module independently of the first cassette.

4. The refrigerator or freezer of any preceding clause, wherein the second cassette is positioned within the interior of the insulated cabinet and the first cassette is positioned vertically above the insulated cabinet.

5. The refrigerator or freezer of clause 4, comprising:
   a defog coil and blower positioned within the second cassette, wherein the blower is configured to blow air through the defog coil and onto a glass door of the insulated cabinet to defog the glass door.

6. The refrigerator or freezer of any preceding clause, comprising:
   a defrost coil positioned within the second cassette adjacent to the evaporator; and
   wherein a fluid pipe extends from the defrost coil to the first cassette place the defrost coil in fluid communication with the condenser.

7. The refrigerator or freezer of clause 6, wherein the fluid pipe is in fluid communication with a coolant side of the condenser to provide coolant to the defrost coil.

8. The refrigerator or freezer of any preceding clause, wherein the refrigeration module further includes a rear chase, and wherein the suction refrigerant pipe and the liquid refrigerant pipe extend through the rear chase.

9. The refrigerator or freezer of any preceding clause, wherein the suction refrigerant pipe includes a refrigerant isolation valve in the first cassette and a refrigerant isolation valve in the second cassette; and
   wherein the liquid refrigerant pipe includes a refrigerant isolation valve in the first cassette and a refrigerant isolation valve in the second cassette.

10. The refrigerator or freezer of any preceding clause, wherein the suction refrigerant pipe and the liquid refrigerant pipe each include a flexible portion extending at least partially between the first and second cassettes such that the first and/or second cassette may be removed from the refrigeration module without disconnecting the suction refrigerant pipe and liquid refrigerant pipe.

11. The refrigeration module of any preceding clauses, comprising:
   a media display mounted adjacent the first cassette.

12. A modular refrigeration system, comprising:
   the refrigerator or freezer of any preceding clause;
   a main system heat exchanger;
   a condenser coolant supply manifold in fluid connection with the main system heat exchanger and the condenser to supply coolant to the condenser from the main system heat exchanger; and
   a condenser coolant return manifold in fluid connection with the main system heat exchanger and the condenser to return coolant from the condenser to the main system heat exchanger.

13. The modular refrigeration system of clause 12, wherein the suction refrigerant pipe has a length extending from the evaporator to the compressor and the liquid refrigerant pipe has a length extending from the condenser to the evaporator;
   wherein the condenser coolant supply manifold has a length and the condenser coolant return manifold has a length; and
   wherein the length of the suction refrigerant pipe and the length of the liquid refrigerant pipe are each shorter than the lengths of the condenser coolant supply manifold and the condenser coolant return manifold.

14. A modular refrigeration system comprising:
   at least two refrigeration modules, wherein each refrigeration module includes:
      a framework;
      a first cassette having a housing and including a compressor and a condenser wherein the first cassette is removable from the framework; and
      a second cassette having a housing and including an evaporator; and
   a main system heat exchanger including a condenser coolant supply manifold in fluid connection with the condenser of each of the at least two refrigeration modules to supply coolant to the condenser, and a condenser coolant return manifold in fluid connection with the condenser of each of the at least two refrigeration modules to return the coolant to the main system heat exchanger; and wherein the at least two refrigeration modules are connected to the condenser coolant supply manifold and the condenser coolant return manifold in parallel so that when the first cassette of one of the at least two refrigeration modules is removed from the framework, the first cassette of another of the at least two refrigeration modules remains in fluid communication with the condenser coolant supply manifold and the condenser coolant return manifold.

15. The modular refrigeration system of clause 14, wherein the condenser coolant supply manifold and the condenser coolant return manifold run through a rear chase of each of the at least two refrigeration modules.

16. The modular refrigeration system of clause 14 or 15, wherein each of the at least two refrigeration modules includes:

a liquid refrigerant pipe extending from the condenser in the first cassette to the evaporator in the second cassette to supply refrigerant to the evaporator from the condenser; and a suction refrigerant pipe that extends from the evaporator in the second cassette to the compressor in the first cassette to supply refrigerant from the evaporator to the compressor.

17. A refrigeration module including:

a first cassette having a housing and including a compressor and a condenser;

a second cassette having a housing and including an evaporator;

a liquid refrigerant pipe extending between the condenser in the first cassette and the evaporator in the second cassette to supply refrigerant to the evaporator from the condenser;

a suction refrigerant pipe extending between the evaporator in the second cassette and the compressor in the first cassette to supply refrigerant to the compressor from the evaporator; and a framework supporting the first cassette and the second cassette;

wherein the first and/or second cassette are/is removable from the framework independently of the other cassette; and wherein the condenser of the first cassette is arranged to receive liquid coolant and transfer heat from the refrigerant to the liquid coolant.

18. The refrigeration module of clause 17, wherein the suction refrigerant pipe and liquid refrigerant pipe each have at least one refrigerant isolation valve positioned within the first cassette;

wherein the suction refrigerant pipe and liquid refrigerant pipe each have at least one refrigerant isolation valve positioned within the second cassette; and wherein the refrigerant isolation valves are configurable to stop flow of refrigerant between the first cassette and the second cassette.

19. The refrigeration module of clause 17 or 18, wherein the suction refrigerant pipe and the liquid refrigerant pipe extend through a rear chase define by the framework.

20. The refrigeration module of clause 17, 18, or 19, comprising:

a defrost coil positioned within the second cassette adjacent to the evaporator; and wherein the defrost coil is in fluid communication with liquid coolant exiting the condenser.

21. The refrigeration module of clause 17, 18, 19, or 20, comprising:

a control panel electrically connected to an electrical busbar and conduit control wiring for data communication.

The invention claimed is:

1. A modular refrigerator or freezer comprising:

an insulated cabinet; and a framework adjacent to said insulated cabinet;

a refrigeration module including:

a compressor, a condenser, and an evaporator;

a liquid refrigerant pipe extending between the condenser and the evaporator to supply refrigerant from the condenser to the evaporator;

a suction refrigerant pipe extending between the evaporator and the compressor to supply refrigerant from the evaporator to the compressor;

wherein the evaporator is in communication with an interior of the insulated cabinet;

wherein the compressor and condenser are included in a first cassette of the refrigeration module, the first cassette having a first cassette housing that fully encapsulates the compressor and the condenser;

wherein the evaporator is included in a second cassette of the refrigeration module, the second cassette having a second cassette housing that fully encapsulates the evaporator; and wherein the first cassette is slidably received within the framework adjacent to said insulated cabinet;

wherein the second cassette is slidably received within the insulated cabinet; and wherein the first and/or second cassette are/is removable from the refrigeration module independently of the other cassette.

2. The refrigerator or freezer of claim 1, wherein the first cassette is removable from the refrigeration module independently of the second cassette.

3. The refrigerator or freezer of claim 1, wherein the second cassette is removable from the refrigeration module independently of the first cassette.

4. The refrigerator or freezer of claim 1, wherein the first cassette is positioned vertically above the insulated cabinet.

5. The refrigerator or freezer of claim 4, comprising:

a defog coil and blower positioned within the second cassette, wherein the blower is configured to blow air through the defog coil and onto a glass door of the insulated cabinet to defog the glass door.

6. The refrigerator or freezer of claim 1, comprising:

a defrost coil positioned within the second cassette adjacent to the evaporator; and wherein a fluid pipe extends from the defrost coil to the first cassette to place the defrost coil in fluid communication with the condenser.

7. The refrigerator or freezer of claim 6, wherein the fluid pipe is in fluid communication with a coolant side of the condenser to provide coolant to the defrost coil.

8. The refrigerator or freezer of claim 1, wherein the refrigeration module further includes a rear chase, and wherein the suction refrigerant pipe and the liquid refrigerant pipe extend through the rear chase.

9. The refrigerator or freezer of claim 1, wherein the suction refrigerant pipe includes a refrigerant isolation valve in the first cassette and a refrigerant isolation valve in the second cassette; and wherein the liquid refrigerant pipe includes a refrigerant isolation valve in the first cassette and a refrigerant isolation valve in the second cassette.

10. The refrigerator or freezer of claim 1, wherein the suction refrigerant pipe and the liquid refrigerant pipe each include a flexible portion extending at least partially between the first and second cassettes such that the first and/or second cassette may be removed from the refrigeration module without disconnecting the suction refrigerant pipe and liquid refrigerant pipe.

11. The refrigeration module of claim 1, comprising:

a media display mounted adjacent the first cassette.

12. A modular refrigeration system, comprising:

the refrigerator or freezer of claim 1;

a main system heat exchanger;

a condenser coolant supply manifold in fluid connection with the main system heat exchanger and the condenser to supply coolant to the condenser from the main system heat exchanger; and a condenser coolant return manifold in fluid connection with the main system heat exchanger and the condenser to return coolant from the condenser to the main system heat exchanger.

13. The modular refrigeration system of claim 12, wherein the suction refrigerant pipe has a length extending from the evaporator to the compressor and the liquid refrigerant pipe has a length extending from the condenser to the evaporator;

wherein the condenser coolant supply manifold has a length and the condenser coolant return manifold has a length; and wherein the length of the suction refrigerant pipe and the length of the liquid refrigerant pipe are each shorter than the lengths of the condenser coolant supply manifold and the condenser coolant return manifold.

14. A modular refrigeration system comprising:

at least two refrigeration modules, wherein each refrigeration module includes:

a framework;

a first cassette having a housing and including a compressor and a condenser wherein the first cassette is removable from the framework; and a second cassette having a housing and including an evaporator; and a main system heat exchanger including a condenser coolant supply manifold in fluid connection with the condenser of each of the at least two refrigeration modules to supply coolant to the condenser, and a condenser coolant return manifold in fluid connection with the condenser of each of the at least two refrigeration modules to return the coolant to the main system heat exchanger; and wherein the at least two refrigeration modules are connected to the condenser coolant supply manifold and the condenser coolant return manifold in parallel so that when the first cassette of one of the at least two refrigeration modules is removed from the framework, the first cassette of another of the at least two refrigeration modules remains in fluid communication with the condenser coolant supply manifold and the condenser coolant return manifold.

15. The modular refrigeration system of claim 14, wherein the condenser coolant supply manifold and the condenser coolant return manifold run through a rear chase of each of the at least two refrigeration modules.

16. The modular refrigeration system of claim 14, wherein each of the at least two refrigeration modules includes:

a liquid refrigerant pipe extending from the condenser in the first cassette to the evaporator in the second cassette to supply refrigerant to the evaporator from the condenser; and a suction refrigerant pipe that extends from the evaporator in the second cassette to the compressor in the first cassette to supply refrigerant from the evaporator to the compressor.

17. A refrigeration module including:

a first cassette having a first cassette housing and including a compressor and a condenser, wherein the first cassette housing surrounds the compressor and the condenser;

a second cassette having a second cassette housing and including an evaporator, wherein the second cassette housing surrounds the evaporator;

a liquid refrigerant pipe extending between the condenser in the first cassette and the evaporator in the second cassette to supply refrigerant to the evaporator from the condenser;

a suction refrigerant pipe extending between the evaporator in the second cassette and the compressor in the first cassette to supply refrigerant to the compressor from the evaporator; and a framework supporting the first cassette;

an insulated cabinet supporting the second cassette;

a defrost coil positioned within the second cassette adjacent to the evaporator, wherein the defrost coil is in fluid communication with liquid coolant exiting the condenser;

wherein the first cassette is removable from the framework and/or the second cassette is removable from the insulated cabinet are independently of the other cassette; and wherein the condenser of the first cassette is arranged to receive liquid coolant and transfer heat from the refrigerant to the liquid coolant; and wherein the defrost coil in the second cassette is configured to use the liquid coolant heated by the condenser to defrost the evaporator.

18. The refrigeration module of claim 17, wherein the suction refrigerant pipe and liquid refrigerant pipe each have at least one refrigerant isolation valve positioned within the first cassette;

wherein the suction refrigerant pipe and liquid refrigerant pipe each have at least one refrigerant isolation valve positioned within the second cassette; and wherein the refrigerant isolation valves are configurable to stop flow of refrigerant between the first cassette and the second cassette.

19. The refrigeration module of claim 17, wherein the suction refrigerant pipe and the liquid refrigerant pipe extend through a rear chase define by the framework.

20. The refrigeration module of claim 17, comprising:

a control panel electrically connected to an electrical busbar and conduit control wiring for data communication.

21. A modular refrigerator or freezer system comprising:

a first insulated cabinet and a second insulated cabinet; and a first refrigeration module associated with the first insulated cabinet and a second refrigeration module associated with the second insulated cabinet, the first refrigeration module and the second refrigeration module each including:

a compressor, a liquid-cooled condenser, and an evaporator;

a liquid refrigerant pipe extending between the condenser and the evaporator to supply refrigerant from the condenser to the evaporator;

a suction refrigerant pipe extending between the evaporator and the compressor to supply refrigerant from the evaporator to the compressor;

wherein the evaporator is in communication with an interior of the associated insulated cabinet;

wherein the compressor and condenser are included in a first cassette of the refrigeration module, the first cassette having a first cassette housing;

wherein the evaporator is included in a second cassette of the refrigeration module, the second cassette having a second cassette housing; and wherein the first and/or second cassette are/is removable from the refrigeration module independently of the other cassette; and wherein the liquid-cooled condensers of the first refrigeration module and second refrigeration module share a non-refrigerant, liquid flow path.

* * * * *